US007307041B2

(12) United States Patent
Geuens et al.

(10) Patent No.: US 7,307,041 B2
(45) Date of Patent: Dec. 11, 2007

(54) STABILIZERS FOR USE IN SUBSTANTIALLY LIGHT-INSENSITIVE THERMOGRAPHIC RECORDING MATERIALS

(75) Inventors: Ingrid Geuens, Emblem (BE); Johan Loccufier, Zwijnaarde (BE); Bart Waumans, Puurs (BE)

(73) Assignee: Agfa Healthcare, Mortsel (BE)

( * ) Notice: Subject to any disclaimer, the term of this patent is extended or adjusted under 35 U.S.C. 154(b) by 274 days.

(21) Appl. No.: 11/220,187

(22) Filed: Sep. 6, 2005

(65) Prior Publication Data

US 2006/0063670 A1 Mar. 23, 2006

Related U.S. Application Data

(60) Provisional application No. 60/611,000, filed on Sep. 17, 2004.

(51) Int. Cl.
*B41M 5/30* (2006.01)

(52) U.S. Cl. ..... 503/209; 503/212

(58) Field of Classification Search ..... None
See application file for complete search history.

(56) References Cited

U.S. PATENT DOCUMENTS

| | | | |
|---|---|---|---|
| 3,031,329 | A | 4/1962 | Wingert |
| 3,074,809 | A | 1/1963 | Richard |
| 3,446,648 | A | 5/1969 | Workman |
| 3,844,797 | A | 10/1974 | Heugebaert et al. |
| 3,911,171 | A | 10/1975 | Janssens et al. |
| 3,951,660 | A | 4/1976 | Hagemann et al. |
| 3,965,282 | A | 6/1976 | Janssens et al. |
| 4,011,352 | A | 3/1977 | Janssens et al. |
| 4,082,901 | A | 4/1978 | Laridon |
| 4,315,068 | A | 2/1982 | Kunikane et al. |
| 5,464,738 | A | 11/1995 | Lynch et al. |
| 5,496,695 | A | 3/1996 | Simpson et al. |
| 5,545,505 | A | 8/1996 | Simpson |
| 5,545,507 | A | 8/1996 | Simspon et al. |
| 5,545,515 | A | 8/1996 | Murray et al. |
| 5,558,983 | A | 9/1996 | Simpson et al. |
| 5,599,647 | A | 2/1997 | Defieuw et al. |
| 5,635,339 | A | 6/1997 | Murray |
| 5,654,130 | A | 8/1997 | Murray |

FOREIGN PATENT DOCUMENTS

| | | | |
|---|---|---|---|
| EP | 0 097 615 | A1 | 1/1984 |
| EP | 0 622 217 | A1 | 11/1994 |
| EP | 0 654 355 | A1 | 5/1995 |
| EP | 0 692 733 | A2 | 1/1996 |
| EP | 0 736 799 | A1 | 10/1996 |
| EP | 0 903 625 | A1 | 3/1999 |
| EP | 0 964 300 | A1 | 12/1999 |
| GB | 1439478 | | 6/1976 |

*Primary Examiner*—Bruce H. Hess
(74) *Attorney, Agent, or Firm*—Leydig, Voit & Mayer, Ltd.

(57) ABSTRACT

A substantially light-insensitive thermographic recording material comprising a support and a thermosensitive element, the thermosensitive element containing a substantially light-insensitive organic silver salt, an organic reducing agent therefor in thermal working relationship therewith, a binder and at least one compound selected from the group consisting of mono-alkyl tetrachloro-phthalates, di-alkyl tetrachlorophthalates and N-(tetrachloro-phthalimyl)$_n$-alkanes, wherein n is an integer greater than or equal to 1.

7 Claims, No Drawings

STABILIZERS FOR USE IN SUBSTANTIALLY LIGHT-INSENSITIVE THERMOGRAPHIC RECORDING MATERIALS

CROSS-REFERENCE TO RELATED PATENT APPLICATIONS

This application claims the benefit of U.S. Provisional Application No. 60/611,000 filed Sep. 17, 2004, which is herein incorporated by reference.

FIELD OF THE INVENTION

The present invention concerns stabilizers for use in the thermosensitive elements of substantially light-insensitive thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

U.S. Pat. No. 3,031,329 discloses a stabilized heat-sensitive copy-sheet for making a clear and sharp reproduction of a graphic original by a thermographic copying procedure involving brief application of a heat-pattern corresponding to said original, said copy-sheet being visibly stable under normal storage conditions and when subjected to elevated temperatures up to about 60° C. for limited periods while being rapidly permanently visibly changed on heating to a conversion temperature of the order of about 90-150° C., said copy-sheet including a visibly heat-sensitive layer containing, in intimate association, a normally solid organic acid salt of a noble metal, and a cyclic organic reducing agent for the noble metal ions, said reducing agent having an active hydrogen atom attached to an atom which is selected from the class of oxygen, nitrogen and carbon atoms and which is directly attached to an atom of the cyclic ring, said reducing agent being capable of causing reduction of silver ions and precipitation of metallic silver on being dissolved at moderate temperature in a solution of aqueous silver nitrate in an organic solvent, and said visibly heat-sensitive layer being characterized by the inclusion of a significant small amount of a perhalogenated aromatic organic acidic stabilizer material sufficient to improve greatly the stability of the heat-sensitive layer. Tetrachlorophthalic acidic material and tetrachlorophthalic anhydride are specifically claimed in U.S. Pat. No. 3,031,329, with the use of tetrachlorophthalic anhydride being specifically disclosed and exemplified and tetrabromophthalic acid and tetrachlorophthalic acid being also specifically disclosed.

U.S. Pat. No. 3,911,171 discloses a thermographic recording process comprising producing a dye image by bringing into image-wise reactive contact with the aid of heat a dye precursor compound and a generally non-crystallizing compound with acid reaction corresponding to the following general formula:

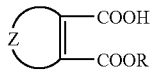

wherein Z represents atoms to close an unsubstituted nucleus, a halogen-substituted nucleus or a nitro-substituted benzene nucleus, and R represents an unsubstituted aliphatic group containing at least 4 carbon atoms, a cycloaliphatic group, or an aliphatic group substituted with hydroxy, with an etherified hydroxyl group or with an acyloxy group.

U.S. Pat. No. 3,965,282 discloses a mono-sheet thermosensitive recording material containing a dye precursor compound and a compound with acid reaction, in which material the compound with acid reaction and the dry precursor compound at a temperature below 60° C. are kept out of direct chemical contact and the compound with acid reaction corresponds to the following general formula:

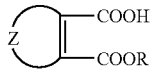

wherein Z represents atoms to close an unsubstituted nucleus, a halogen-substituted nucleus or a nitro-substituted benzene nucleus, and R represents an unsubstituted aliphatic group containing at least 4 carbon atoms, a cycloaliphatic group or an aliphatic group substituted with hydroxy, with an etherified hydroxyl group or with an acyloxy group.

U.S. Pat. No. 3,911,171 and U.S. Pat. No. 3,965,282 specifically disclose the following mono-esters of tetrachlorophthalic acid: isobutyl, 2-hydroxyethyl, 3-hydroxybutyl, 2,2-dimethyl-3-hydroxy-propyl, n-butyl, 2-ethylbutyl, 2-methylpentyl, 2-methoxy-ethyl, cyclohexyl, 1-methylpentyl, decyl and 9-vinyl-nonyl.

U.S. Pat. No. 4,011,352 discloses a thermographic recording process in which a dye is produced by bringing image-wise into reactive contact with the aid of heat an organic acid-reacting compound with a dye precursor compound, the improvement being producing a light stable yellow image by bringing said compound into contact with a dye precursor corresponding to the following general formula:

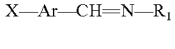

wherein: Ar represents a phenylene nucleus, $R_1$ represents a phenyl group and X represents a

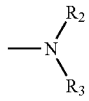

group wherein each of $R_2$ and $R_3$ (same or different) represents an alkyl group, a cyanoalkyl group, a chloroalkyl group, and an alkoxy carbonylalkyl group. U.S. Pat. No. 4,011,352 specifically discloses the monomethyl, monoethyl and monoisopropyl tetrachlorophthalates.

U.S. Pat. No. 4,315,068 discloses a photo-sensitive and heat-sensitive composition which comprises (a) a photooxidant, (b) a color-generator generating color when oxidized, (c) an acid promoting said color generation, (d) a cobalt (III)

amine and/or amine complex, (e) a photoreductant, (f) a hydrogen donator, (g) at least one kind of chelating agent selected from dioxime chelating agents having the following general formula (I):

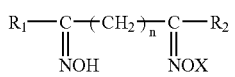

(I)

(wherein n is an integer of 0 to 3, and $R_1$ and $R_2$ can each represent an alkyl, aryl or aralkyl group) and diantipyrylmethane chelating agents having the following general formula (II):

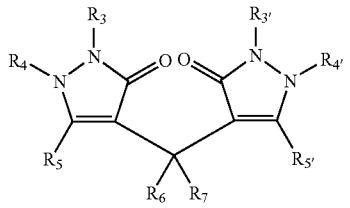

(wherein $R_3$, $R_4$, $R_5$, $R_3'$, $R_4'$ and $R_5'$ can each represent a hydrogen atom and an alkyl or aryl group, and $R_6$ and $R_7$ can each represent a hydrogen atom and an alkyl, substituted or non-substituted aryl or aralkyl group), and (h) at least one kind of stabilizer selected from noble metal complexes, organic oxidants and organic acids. Among the organic oxidants disclosed are compounds having the general formula (7):

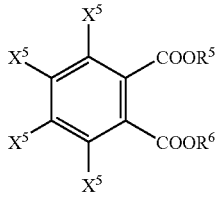

(wherein, $X^5$ can represent chlorine or bromine, and $R^5$ and $R^6$ can represent $C_1$-$C_{12}$ straight chain or branched alkyl groups). As their exemplary examples there can be enumerated tetrachlorophthalic acid, monomethyl tetrachlorophthalate, diethyl tetrachlorophthalate, dioctyl tetrachlorophthalate and the like.

EP-A 0 097 615 discloses a process for preparing particular cyanobenzoic acid esters and discloses the use of the monomethyl tetrachlorophthalate as a starting material in this process.

U.S. Pat. No. 3,911,171, U.S. Pat. No. 3,965,282, U.S. Pat. No. 4,011,352 and U.S. Pat. No. 4,315,068 all disclose the use of mono-alkyl and/or dialkyl tetrachlorophthalates in heat- and photo-sensitive imaging elements, but as organic oxidants for use with a dye precursor rather than in association with substantially light-insensitive organic silver salts and reducing agents therefor.

Substantially light-insensitive thermographic recording materials based on substantially light-insensitive organic silver salts contain the imaging-forming components both before and after image formation and unwanted image-forming must be hindered during storage prior to printing, in prints exposed to light on light-boxes e.g. during examination by radiologists, and during storage of prints under dark conditions. Furthermore, such stabilization must take place without adverse effects upon the image quality particularly the image tone and Dmax. Stabilizers for substantially light-insensitive thermographic recording materials based on substantially light-insensitive organic silver salts, such as tetrachlorophthalic anhydride, tetrachlorophthalic acid and benzotriazole, are known, which realize acceptable image stabilization upon archival and upon exposure to light with acceptable deterioration in image tone. However, such stabilizers decrease Dmax, a decrease which is substantial at the concentrations required for realizing acceptable image stabilization. There is therefore a continuing need for new stabilizers for substantially light-insensitive thermographic recording materials based on substantially light-insensitive organic silver salts which provide image stabilization without adverse effects upon image tone and Dmax.

ASPECTS OF THE INVENTION

It is therefore an aspect of the present invention to provide stabilizers which provide substantially light-insensitive thermographic recording materials based on substantially light-insensitive organic silver salts with image stabilization without adverse effects upon image tone, particularly upon CIELAB b* values, and Dmax.

Further aspects and advantages of the invention will become apparent from the description hereinafter.

SUMMARY OF THE INVENTION

It has been surprisingly found that the incorporation of at least one compound selected from the group consisting of mono-alkyl tetrachlorophthalates, di-alkyl tetrachlorophthalates and $[N\text{-(tetrachlorophthalimyl)}]_n$-alkanes, wherein n is an integer greater than or equal to 1 into the thermosensitive element of substantially light-insensitive thermographic recording materials containing a substantially light-insensitive organic silver salt provides high maximum image densities and an improvement in the stability of the image upon storage in the dark, particularly in respect of b* CIELAB values over the use of tetrachlorophthalic anhydride, tetrachlorophthalic acid or mixtures thereof.

Aspects of the present invention have been realized by a substantially light-insensitive thermographic recording material comprising a thermosensitive element and a support, the thermosensitive element containing a substantially light-insensitive organic silver salt, a reducing agent therefor in thermal working relationship therewith, a binder and at least one compound selected from the group consisting of mono-alkyl tetrachlorophthalates, di-alkyl tetrachlorophthalates and $[N\text{-(tetrachlorophthalimyl)}]_n$-alkanes, wherein n is an integer greater than or equal to 1.

Preferred embodiments of the present invention are disclosed in the detailed description of the invention.

DETAILED DESCRIPTION OF THE INVENTION

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl; for six carbon atoms: n-hexyl, 1-methyl-pentyl, 2-methyl-pentyl, 3-methyl-pentyl, 4-methyl-pentyl, 1-ethyl-butyl, 2-ethyl-butyl etc.

The L*, a* and b* CIELAB-values are defined in ASTM Norm E179-90 in a R(45/0) geometry with evaluation according to ASTM Norm E308-90, herein incorporated by reference.

Substantially light-insensitive means not intentionally light sensitive.

Thermographic Recording Material

Aspects of the present invention have been realized by a substantially light-insensitive thermographic recording material comprising a thermosensitive element and a support, the thermosensitive element containing a substantially light-insensitive organic silver salt, a reducing agent therefor in thermal working relationship therewith, a binder and at least one compound selected from the group consisting of mono-alkyl tetrachlorophthalates, di-alkyl tetrachlorophthalates and [N-(tetrachlorophthalimyl)]$_n$-alkanes, wherein n is an integer greater than or equal to 1.

According to a first embodiment of the substantially light-insensitive black and white monosheet thermographic recording material, according to the present invention, the thermographic recording material is a black and white thermographic recording material.

According to a second embodiment of the substantially light-insensitive thermographic recording material, according to the present invention, the thermographic recording material is a monosheet thermographic recording material.

According to a third embodiment of the substantially light-insensitive thermographic recording material, according to the present invention, the thermosensitive element further comprises tetrachlorophthalic anhydride and/or tetrachlorophthalic acid.

Thermosensitive Element

The term thermosensitive element as used herein is that element which comprises all the ingredients which contribute to image formation. According to the present invention, the thermosensitive element comprises one or more substantially light-insensitive organic silver salts, one or more reducing agents therefor in thermal working relationship therewith and a binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

Monoalkyl or Dialkyl Tetrachlorophthalates

Aspects of the present invention have been realized by a substantially light-insensitive thermographic recording material comprising a thermosensitive element and a support, the thermosensitive element containing a substantially light-insensitive organic silver salt, a reducing agent therefor in thermal working relationship therewith, a binder and at least one compound selected from the group consisting of mono-alkyl tetrachlorophthalates, di-alkyl tetrachlorophthalates and [N-(tetrachlorophthalimyl)]$_n$-alkanes, wherein n is an integer greater than or equal to 1.

According to a fourth embodiment of the substantially light-insensitive thermographic recording material, according to the resent invention, the at least one compound selected from the group consisting of mono-alkyl tetrachlorophthalates, di-alkyl tetrachlorophthalates and [N-(tetrachlorophthalimyl)]$_n$-alkanes, wherein n is an integer greater than or equal to 1 is a mono-$C_1$-$C_{10}$-alkyl tetrachlorophthalate.

According to a fifth embodiment of the substantially light-insensitive thermographic recording material, according to the present invention, the at least one compound selected from the group consisting of mono-alkyl tetrachlorophthalates, di-alkyl tetrachlorophthalates and [N-(tetrachlorophthalimyl)]$_n$-alkanes, wherein n is an integer greater than or equal to 1 is a di-$C_1$-$C_{10}$-alkyl tetrachlorophthalate in which the alkyl groups are independent of one another.

According to a sixth embodiment of the substantially light-insensitive thermographic recording material, according to the present invention, the at least one compound selected from the group consisting of mono-alkyl tetrachlorophthalates, di-alkyl tetrachlorophthalates and [N-(tetrachlorophthalimyl)]$_n$-alkanes, wherein n is an integer greater than or equal to 1 is selected from the group consisting of: monomethyl tetrachlorophthalate, monoethyl tetrachlorophthalate, monopropyl tetrachlorophthalate, monobutyl tetrachlorophthalate, monopentyl tetrachlorophthalate, monohexyl tetrachlorophthalate, monoheptyl tetrachlorophthalate and mono-octyl tetrachlorophthalate, According to a seventh embodiment of the substantially light-insensitive thermographic recording material, according to the present invention, the at least one compound selected from the group consisting of mono-alkyl tetrachlorophthalates, di-alkyl tetrachlorophthalates and N[N-(tetrachlorophthalimyl)]$_n$-alkanes, wherein n is an integer greater than or equal to 1 is selected from the group consisting of: dimethyl tetrachlorophthalate, diethyl tetrachlorophthalate, dipropyl tetrachlorophthalate, dibutyl tetrachlorophthalate, dipentyl tetrachlorophthalate, dihexyl tetrachlorophthalate, diheptyl tetrachlorophthalate and dioctyl tetrachlorophthalate.

According to an eighth embodiment of the substantially light-insensitive thermographic recording material, according to the present invention, the at least one compound selected from the group consisting of mono-alkyl tetrachlorophthalates, di-alkyl tetrachlorophthalates and [N-(tetrachlorophthalimyl)]$_n$-alkanes, wherein n is an integer greater than or equal to 1 is monomethyl tetrachlorophthalate.

Monoalkyl and dialkyl tetrachlorophthalates can be prepared from readily available starting materials using standard organic chemistry techniques known to one skilled in the art and available in such reference books as Houben-Weyl.

Suitable monoalkyl tetrachlorophthalates (MAE) and dialkyl tetrachlorophthalate (DAE) used in the thermosensitive element of the substantially light-insensitive thermographic recording materials, according to the present invention, include:

| | Structure |
|---|---|
| MAE-01 | 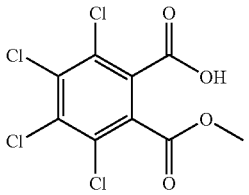 monomethyl tetrachlorophthalate |
| MAE-02 | monoethyl tetrachlorophthalate |
| MAE-03 | Mono-n-propyl tetrachlorophthalate |
| MAE-04 | mono-isopropyl tetrachlorophthalate |
| MAE-05 | Mono-n-butyl tetrachlorophthalate |
| MAE-06 | mono-n-pentyl tetrachlorophthalate |
| MAE-07 | 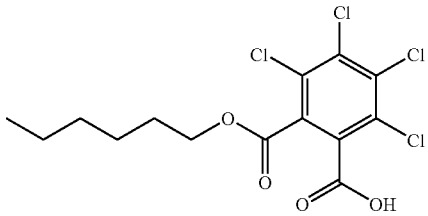 mono-n-hexyl tetrachlorophthalate |
| MAE-08 | 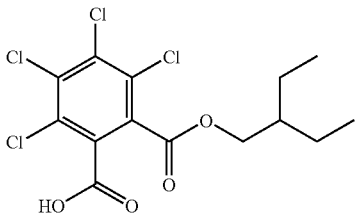 mono-2-ethylbutyl tetrachlorophthalate |
| MAE-09 | mono-n-heptyl tetrachlorophthalate |
| MAE-10 | 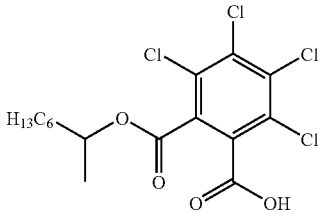 mono-1-methylheptyl tetrachlorophthalate |
| MAE-11 | mono-2-ethylhexyl tetrachlorophthalate |
| MAE-12 | mono-n-octyl tetrachlorophthalate |
| DAE-01 | 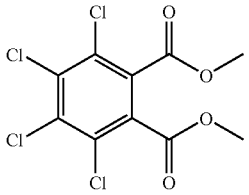 dimethyl tetrachlorophthalate |
| DAE-02 | diethyl tetrachlorophthalate |
| DAE-03 | di-n-propyl tetrachlorophthalate |
| DAE-04 | di-isopropyl tetrachlorophthalate |
| DAE-05 | di-n-butyl tetrachlorophthalate |
| DAE-06 | di-n-pentyl tetrachlorophthalate |
| DAE-07 | di-n-hexyl tetrachlorophthalate |
| DAE-08 | di-2-ethylbutyl tetrachlorophthalate |

-continued

| | Structure |
|---|---|
| DAE-09 | di-n-heptyl tetrachlorophthalate |
| DAE-10 | di-2-ethylhexyl tetrachlorophthalate |
| DAE-11 | di-n-octyl tetrachlorophthalate |

[N-(tetrachlorophthalimyl)]$_n$-alkanes

Aspects of the present invention have been realized by a substantially light-insensitive thermographic recording material comprising a thermosensitive element and a support, the thermosensitive element containing a substantially light-insensitive organic silver salt, a reducing agent therefor in thermal working relationship therewith, a binder and at least one compound selected from the group consisting of mono-alkyl tetrachlorophthalates, di-alkyl tetrachlorophthalates and [N-(tetrachlorophthalimidyl))]$_n$-alkanes, wherein n is an integer greater than or equal to 1.

According to a ninth embodiment of the substantially light-insensitive thermographic recording material, according to the present invention, n is at least 2.

According to a tenth embodiment of the substantially light-insensitive thermographic recording material, according to the present invention, the at least one compound selected from the group consisting of mono-alkyl tetrachlorophthalates, di-alkyl tetrachlorophthalates and [N-(tetrachlorophthalimyl)]$_n$-alkanes, wherein n is an integer greater than or equal to 1 is N,N'-bis-α,ω-(tetrachlorophthalimidyl)-n-hexane.

N-(tetrachlorophthalimyl)-alkanes can be prepared from readily available starting materials using standard organic chemistry techniques known to one skilled in the art and available in such reference books as Houben-Weyl.

Suitable N-(tetrachlorophthalimyl)-alkanes used in the thermosensitive element of the substantially light-insensitive thermographic recording materials, according to the present invention, include:

| | Structure |
|---|---|
| TCFIA-01 | 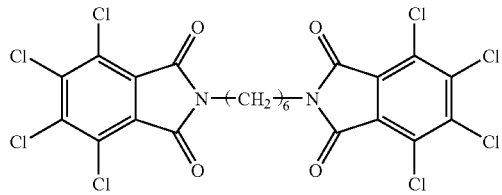 N,N'-bis-α,ω-(tetrachlorophthalimidyl)-n-hexane |
| TCFIA-02 | 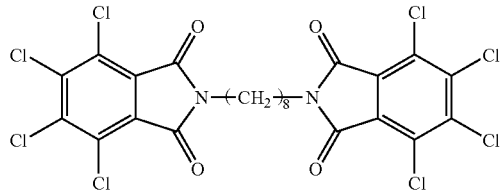 N,N'-bis-α,ω-(tetrachlorophthalimidyl)-n-octane |

-continued

| | Structure |
|---|---|
| TCFIA-03 | 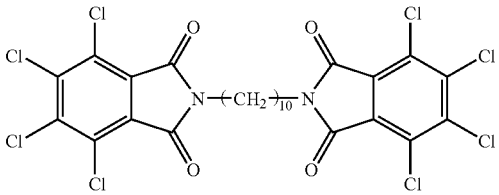 N,N'-bis-α,ω-(tetrachlorophthalimidyl)-n-decane |
| TCFIA-04 | 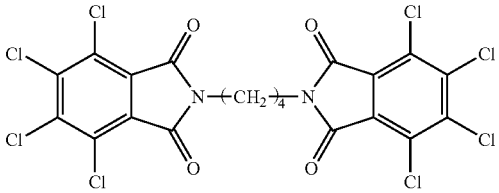 N,N'-bis-α,ω-(tetrachlorophthalimidyl)-n-butane |
| TCFIA-05 | 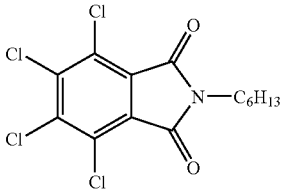 N-n-hexyl-tetrachlorophthalimide |
| TCFIA-06 | 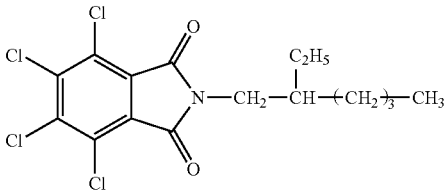 N-(2-ethylhexyl)-tetrachlorophthalimide |
| TCFIA-07 | 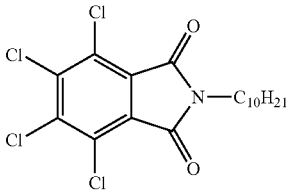 N-n-decyl-tetrachlorophthalimide |

Organic Silver Salt

According to an eleventh embodiment of the substantially light-insensitive thermographic recording material, according to the present invention, the organic silver salts are not double organic salts containing a silver cation associated with a second cation e.g. magnesium or iron ions.

According to a twelfth embodiment of the substantially light-insensitive thermographic recording material of the present invention, at least one of the organic silver salts is a substantially light-insensitive silver salt of an organic carboxylic acid.

According to a thirteenth embodiment of the substantially light-insensitive thermographic recording material of the present invention, at least one of the organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300,herein incorporated by reference.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Reducing Agents

According to a fourteenth embodiment of the black and white thermographic recording material, according to the present invention, the reducing agent is an organic compound containing at least one active hydrogen atom linked to O, N or C, such as is the case with, aromatic di- and tri-hydroxy compounds. 1,2-dihydroxy-benzene derivatives, such as catechol, 3-(3,4-dihydroxyphenyl)propionic acid, 1,2-dihydroxybenzoic acid, gallic acid and esters thereof e.g. methyl gallate, ethyl gallate, propyl gallate, tannic acid, and 3,4-dihydroxy-benzoic acid esters are preferred, with those described in EP-A 0 692 733 and EP-A 0 903 625 being particularly preferred, herein incorporated by reference.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

The binder of the thermosensitive element is capable of forming films and may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the thermographic recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which adversely affect the thermographic properties of the thermographic recording materials in which they are used.

Toning Agent

According to a fifteenth embodiment of the thermographic recording material, according to the present invention, the thermosensitive element comprises a toning agent, which enables a neutral black image tone to be obtained in the higher densities and neutral grey in the lower densities.

According to a sixteenth embodiment of the thermographic recording material, according to the present invention, the thermosensitive element further comprises a toning agent selected from the group consisting of phthalimides, phthalazinones, benzoxazine diones and naphthoxazine diones e.g. phthalimides and phthalazinones within the scope of the general formulae described in U.S. Pat. No. 4,082,901; the toning agents described in U.S. Pat. No. 3,074,809, 3,446,648 and 3,844,797; and the heterocyclic toner compounds of the benzoxazine dione or naphthoxazine dione type as disclosed in GB 1,439,478, U.S. Pat. No. 3,951,660 and U.S. Pat. No. 5,599,647, herein incorporated by reference.

According to a seventeenth embodiment of the substantially light-insensitive thermographic recording material, according to the present invention, the substantially light-insensitive thermographic material comprises a thermosensitive element, the thermosensitive element containing one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]-oxazine-2,4-dione and 7-(ethylcarbonato)-benzo[e][1,3]oxazine-2,4-dione.

Auxiliary Antifoggants

According to an eighteenth embodiment of the thermographic recording material, according to the present invention, the thermographic recording material further comprises an auxiliary antifoggant to obtain improved shelf-life and reduced fogging.

According to a nineteenth embodiment of the thermographic recording material, according to the present invention, the thermographic recording material further comprises an antifoggant selected from the group consisting of benzotriazole, substituted benzotriazoles and aromatic polycarboxylic acid such as ortho-phthalic acid, 3-nitro-phthalic acid, tetrachlorophthalic acid, mellitic acid, pyromellitic acid and trimellitic acid and anhydrides thereof.

According to a twentieth embodiment of the thermographic recording material, according to the present invention, the thermosensitive element further comprises an optionally substituted benzotriazole.

Polycarboxylic Acids and Anhydrides Thereof

According to a twenty-first embodiment of the thermographic recording material, according to the present invention, the thermosensitive element further comprises at least one polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Surfactants and Dispersants

Surfactants and dispersants aid the dispersion of ingredients which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a twenty-second embodiment of the substantially light-insensitive thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

According to a twenty-third embodiment of the substantially light-insensitive thermographic recording material, according to the present invention, the thermosensitive element is provided with a protective layer. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA, herein incorporated by reference. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200-1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355, herein incorporated by reference, discloses a method for making an image by image-wise heating by means of a thermal head having energizable heating elements, wherein the activation of the heating elements is executed duty cycled pulsewise. EP-A 622 217, herein incorporated by reference, discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

INDUSTRIAL APPLICATION

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Subbing layer Nr. 01 on the emulsion side of the support:

| | |
|---|---|
| copolymer of 88% vinylidene chloride, 10% methyl acrylate and 2% itaconic acid | 79.1 mg/m$^2$ |
| Kieselsol ® 100F, a colloidal silica from BAYER | 18.6 mg/m$^2$ |
| Mersolat ® H, a surfactant from BAYER | 0.4 mg/m$^2$ |
| Ultravon ® W, a surfactant from CIBA-GEIGY | 1.9 mg/m$^2$ |

Ingredients in the Thermosensitive Element in Addition to the Above-Mentioned Ingredients:

BL5HP=S-LEC BL5HP, a polyvinyl butyral from SEKISUI;
B79=BUTVAR™ B79, a polyvinyl butyral from SOLUTIA;
Oil=BAYSILON, a silicone oil from BAYER;

Reducing Agents:
R01=ethyl 3,4-dihydroxybenzoate
R02=3,4-dihydroxybenzonitrile;

Toning Agent:
T01=7-(ethylcarbonato)-benzo[e][1,3]oxazine-2,4-dione;
T02=7-methyl-benzo[e][1,3]oxazine-2,4-dione;
T03=benzo[e][1,3]oxazine-2,4-dione Auxiliary Stabilizers:
S01=glutaric acid
S02=adipic acid
S03=benzotriazole Ingredient from U.S. Pat. No. 3,031,329 used in the Thermosensitive Element of the Comparative Examples:
TCFA=Tetrachlorophthalic anhydride Other Tetrachlorophthalic Acid Derivatives:

IPTCFI =

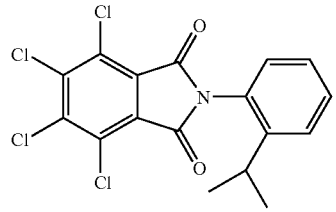

N-(2-isopropyl-phenyl)-tetrachlorophthalimide

Ingredients in the Protective Layer:

ERCOL™ 48 20=a polyvinylalcohol from ACETEX EUROPE;
LEVASIL™ VP AC 4055=a 15% aqueous dispersion of colloidal silica with acid groups predominantly neutralized with sodium ions and a specific surface are of 500 m$^2$/g, from BAYER AG has been converted into the ammonium salt;
ULTRAVON™ W=75-85% concentrate of a sodium arylsulfonate from Ciba Geigy converted into acid form by passing through an ion exchange column;
SYLOID™ 72=a silica from Grace;
SERVOXYL™ VPDZ 3/100=a mono[isotridecyl polyglycolether (3 EO)]phosphate, from SERVO DELDEN B.V.;
SERVOXYL™ VPAZ 100=a mixture of monolauryl and dilauryl phosphate, from SERVO DELDEN B.V.;

MICROACE TALC P3=an Indian talc from NIPPON TALC;

RILANIT™ GMS=a glycerine monotallow acid ester, from HENKEL AG

TMOS=tetramethylorthosilicate hydrolyzed in the presence of methanesulfonic acid.

INVENTION EXAMPLES 1 TO 6 AND COMPARATIVE EXAMPLES 1 TO 5

The substantially light-insensitive thermographic materials of INVENTION EXAMPLES 1 to 6 and COMPARATIVE EXAMPLES 1 to 5 were prepared by coating a dispersion with the following ingredients in 2-butanone onto a 175 μm thick blue-pigmented polyethylene terephthalate support with CIELAB a*- and b*-values of −8.0±0.1 and −17.9±0.1 respectively subbed on the emulsion-coated side with subbing layer 01 giving layers after drying at 85° C. for 4 minutes in a drying cupboard with the compositions given in Table 1.

TABLE 1

| | stabilizer | | | | R01 | R02 | T01 | S01 | S03 | |
|---|---|---|---|---|---|---|---|---|---|---|
| | type | conc. mol % vs AgB | AgBeh coverage [g/m²] | BL5HP [g/m²] | mol % vs AgB | mol % vs AgB | mol % vs AgB | mol % vs AgB | mol % vs AgB | Oil [mg/m²] |
| Comparative example nr | | | | | | | | | | |
| 1 | — | — | 5.746 | 21.835 | 28.6 | 46.3 | 9.1 | 22 | 9.9 | 51 |
| 2 | TCFA | 2.46 | 5.746 | 21.835 | 28.6 | 46.3 | 9.1 | 22 | 9.9 | 51 |
| 3 | TCFA | 4.92 | 5.746 | 21.835 | 28.6 | 46.3 | 9.1 | 22 | 9.9 | 51 |
| 4 | TCFA | 4.92 | 5.746 | 21.835 | 28.6 | 46.3 | 9.1 | 22 | 9.9 | 51 |
| 5 | TCFA | 5.9 | 5.746 | 21.835 | 28.6 | 46.3 | 9.1 | 22 | 9.9 | 51 |
| Invention example nr | | | | | | | | | | |
| 1 | MAE-1 | 5 | 5.746 | 21.835 | 28.6 | 46.3 | 9.1 | 22 | 9.9 | 51 |
| 2 | MAE-1 | 5 | 5.746 | 21.835 | 28.6 | 46.3 | 9.1 | 22 | 9.9 | 51 |
| 3 | MAE-1 | 6 | 5.746 | 21.835 | 28.6 | 46.3 | 9.1 | 22 | 9.9 | 51 |
| 4 | MAE-1 | 10 | 5.746 | 21.835 | 28.6 | 46.3 | 9.1 | 22 | 9.9 | 51 |
| 5 | MAE-1 | 12.5 | 5.746 | 21.835 | 28.6 | 46.3 | 9.1 | 22 | 9.9 | 51 |
| 6 | DAE-1 | 5 | 5.746 | 21.835 | 28.6 | 46.3 | 9.1 | 22 | 9.9 | 51 |

The thermosensitive elements were then coated with an aqueous composition with the following ingredients, which was adjusted to a pH of 3.8 with 1N nitric acid, to a wet layer thickness of 85 μm and dried for 2 minutes at room temperature in situ and then at 50° C. for 15 minutes to produce a protective layer with the composition:

| | |
|---|---|
| ERCOL ™ 48 20 = | 2.1 g/m² |
| LEVASIL ™ VP AC 4055 = | 1.05 g/m² |
| ULTRAVON ™ W = | 0.075 g/m² |
| SYLOID ™ 72 = | 0.09 g/m² |
| SERVOXYL ™ VPDZ 3/100 = | 0.075 g/m² |
| SERVOXYL ™ VPAZ 100 = | 0.075 g/m² |
| MICROACE TALC P3 = | 0.045 g/m² |
| RILANIT ™ GMS = | 0.15 g/m² |
| TMOS = | 0.87 g/m² (assuming that the TMOS was completely converted to $SiO_2$) |

After coating the protective layer was hardened by heating the substantially light-insensitive thermographic material at 45° C. for 7 days at a relative humidity of 70%.

Thermographic Printing

The substantially light-insensitive thermographic recording materials of INVENTION EXAMPLES 1 to 6 and COMPARATIVE EXAMPLES 1 to 5 were printed using a DRYSTAR™ 4500 printer from AGFA-GEVAERT with a resolution of 508 dpi and a line-time of 7.1 ms and in which the 75 μm long (in the transport direction) and 50 μm wide thermal head resistors were power-modulated to produce different image densities.

The maximum densities of the images ($D_{max}$) were measured through a visible filter with a MACBETH™ TR924 densitometer.

Evaluation of Thermographic Properties

The image tone of fresh prints made with the substantially light-insensitive thermographic recording materials of INVENTION EXAMPLES 1 to 6 and COMPARATIVE EXAMPLES 1 to 5 was assessed on the basis of the L*, a* and b* CIELAB-values at optical densities, D, of 1.0 and 2.0 and the results given in Table 2.

Archivability tests were performed by storing exposing prints made with the substantially light-insensitive thermographic materials of INVENTION EXAMPLES 1 to 6 and COMPARATIVE EXAMPLES 1 to 5 for 3 days in the dark at 57° C. and 34% RH. The shift in CIELAB b*-values at an optical density, D, of 1.0 was determined for INVENTION EXAMPLES 1 to 6 and COMPARATIVE EXAMPLES 1 to 5 and the results are given in Table 2.

The results in Table 2 surprisingly show that, for a particular composition of thermosensitive element, MAE-1 and DAE-1 at comparable molar concentrations only have a slight depressing effect on Dmax and on the CIELAB b* values at D=1 and D=2, whereas TCFA has a considerable depressing effect on Dmax. Moreover, at concentrations of 10 mol % and more versus silver behenate the CIELAB b* values actually increased with increasing MAE-1 concentration which is a totally unexpected effect. Furthermore, this is all accomplished without significant loss in sensitometry and moreover the image density stability during archival in the dark for 3 days at 57° C. and 34% RH with MAE-1 and DAE-1, as shown by the ΔD values, is comparable at comparable concentrations for substantially light insensitive thermographic recording materials containing MAE-1 and DAE-1 with the stability realized with substantially light-insensitive thermographic recording materials containing TCFA.

TABLE 2

| | stabilizer | | | | CIELAB-values of fresh prints | | Shift in Density ΔD at D = 1 of prints |
|---|---|---|---|---|---|---|---|
| | type | conc. mol % vs AgB | D at step 8 | Dmax | D = 1.0 b* | D = 2.0 b* | after 3 d/57° C./34% RH dark storage |
| Comparative Example nr. | | | | | | | |
| 1 | — | — | 1.69 | 4.09 | −6.95 | −3.88 | +0.25 |
| 2 | TCFA | 2.46 | 1.74 | 3.96 | −6.78 | −4.24 | +0.17 |
| 3 | TCFA | 4.92 | 1.54 | 3.84 | −6.16 | −3.71 | +0.15 |
| 4 | TCFA | 4.92 | 1.65 | 3.84 | −6.63 | −3.88 | +0.19 |
| 5 | TCFA | 5.9 | | | −5.89 | −3.02 | +0.15 |
| Invention Example nr | | | | | | | |
| 1 | MAE-1 | 5 | 1.68 | 4.01 | −6.28 | −4.63 | +0.17 |
| 2 | MAE-1 | 5 | 1.64 | 3.93 | −6.81 | −4.70 | +0.18 |
| 3 | MAE-1 | 6 | | | −6.76 | −5.31 | +0.17 |
| 4 | MAE-1 | 10 | 1.64 | 4.07 | −7.86 | −6.39 | +0.17 |
| 5 | MAE-1 | 12.5 | 1.62 | 4.13 | −7.70 | −6.11 | +0.14 |
| 6 | DAE-1 | 5 | 1.65 | 4.08 | −5.23 | −3.30 | +0.22 |

INVENTION EXAMPLES 7 AND 8 AND COMPARATIVE EXAMPLES 6 TO 8

The substantially light-insensitive thermographic materials of INVENTION EXAMPLES 7 to 8 and COMPARATIVE EXAMPLES 6 to 8 were prepared by coating a dispersion with the following ingredients in 2-butanone onto a 175 μm thick blue-pigmented polyethylene terephthalate support with CIELAB a*- and b*-values of −7.7±0.1 and −17.9±0.1 respectively subbed on the emulsion-coated side with subbing layer 01 giving layers after drying at 85° C. for 4 minutes in a drying cupboard with the compositions given in Table 3.

The thermosensitive elements were then coated with an aqueous composition with the following ingredients, which was adjusted to a pH of 3.8 with 1N nitric acid, to a wet layer thickness of 85 μm and dried for 2 minutes at room temperature in situ and then at 50° C. for 15 minutes to produce a protective layer with the composition:

| | |
|---|---|
| ERCOL ™ 48 20 = | 2.1 g/m$^2$ |
| LEVASIL ™ VP AC 4055 = | 1.05 g/m$^2$ |
| ULTRAVON ™ W = | 0.075 g/m$^2$ |
| SYLOID ™ 72 = | 0.09 g/m$^2$ |
| SERVOXYL ™ VPDZ 3/100 = | 0.075 g/m$^2$ |
| SERVOXYL ™ VPAZ 100 = | 0.075 g/m$^2$ |
| MICROACE TALC P3 = | 0.045 g/m$^2$ |
| RILANIT ™ GMS = | 0.15 g/m$^2$ |
| TMOS = | 0.87 g/m$^2$ (assuming that the TMOS was completely converted to $SiO_2$) |

TABLE 3

| | stabilizer | | | | R01 | R02 | T02 | S01 | S03 | |
|---|---|---|---|---|---|---|---|---|---|---|
| | type | conc. mol % vs AgB | AgBeh coverage [g/m$^2$] | BL5HP [g/m$^2$] | mol % vs AgB | mol % vs AgB | mol % vs AgB | mol % vs AgB | mol % vs AgB | Oil [mg/m$^2$] |
| ComparAtive example nr. | | | | | | | | | | |
| 6 | — | — | 5.746 | 21.835 | 28.6 | 46.3 | 20 | 22 | 10 | 51 |
| 7 | TCFA | 2.5 | 5.746 | 21.835 | 28.6 | 46.3 | 20 | 22 | 10 | 51 |
| 8 | TCFA | 5.0 | 5.746 | 21.835 | 28.6 | 46.3 | 20 | 22 | 10 | 51 |
| Invention example nr. | | | | | | | | | | |
| 7 | MAE-1 | 6.0 | 5.746 | 21.835 | 28.6 | 46.3 | 20 | 22 | 10 | 51 |
| 8 | MAE-1 | 8.0 | 5.746 | 21.835 | 28.6 | 46.3 | 20 | 22 | 10 | 51 |

After coating the protective layer was hardened by heating the substantially light-insensitive thermographic material at 45° C. for 7 days at a relative humidity of 70%.

Thermographic Printing

Thermographic printing of the substantially light-insensitive thermographic recording materials of INVENTION EXAMPLES 7 and 8 and COMPARATIVE EXAMPLES 6 to 8 was carried out as described for INVENTION EXAMPLES 1 to 6 and COMPARATIVE EXAMPLES 1 to 5.

The maximum densities of the images ($D_{max}$) were measured through a visable filter with a MACBETH™ TR924 densitometer.

Evaluation of Thermographic Properties

The thermographic properties of the substantially light-insensitive thermographic recording materials of INVENTION EXAMPLES 7 and 8 and COMPARATIVE EXAMPLES 6 to 8 was evaluated as described for INVENTION EXAMPLES 1 to 6 and COMPARATIVE EXAMPLES 1 to 5. The results are summarized in Table 4.

TABLE 4

| | stabilizer | | | | CIELAB-values of fresh prints | | Shift in Density ΔD at D = 1 of prints |
|---|---|---|---|---|---|---|---|
| | type | conc. mol % vs AgB | D at step 8 | Dmax | D = 1.0 b* | D = 2.0 b* | after 3 d/57° C./34% RH dark storage |
| Comparative Example nr. | | | | | | | |
| 6 | — | — | 2.06 | 4.20 | −5.44 | −3.03 | +0.32 |
| 7 | TCFA | 2.5 | 1.93 | 4.07 | −5.97 | −4.12 | +0.26 |
| 8 | TCFA | 5.0 | 1.84 | 3.93 | −6.26 | −4.71 | +0.21 |
| Invention example nr | | | | | | | |
| 7 | MAE-1 | 6.0 | 1.90 | 4.04 | −7.27 | −5.34 | +0.21 |
| 8 | MAE-1 | 8.0 | 1.82 | 3.95 | −7.67 | −5.67 | +0.18 |

The results in Table 4 show that as the TCFA concentration in the thermosensitive element of the substantially light-insensitive thermographic recording materials increases, the stability upon archival for 3 days in the dark at 57° C. and 34% RH improves together with the CIELAB b* values at densities of 1.0 and 2.0, but at the expense of Dmax and weaker sensitometry. On the other hand, if MAE-1 is used in the thermosensitive element of the substantially light-insensitive thermographic recording materials, higher CIELAB b* values at densities of 1.0 and D.0 are realized with a comparable stability and only a slight decrease in Dmax over the situation without stabilizer.

INVENTION EXAMPLES 9 TO 13 AND COMPARATIVE EXAMPLES 9 AND 10

The substantially light-insensitive thermographic materials of INVENTION EXAMPLES 9 to 13 and COMPARATIVE EXAMPLES 9 and 10 were prepared by coating a dispersion with the following ingredients in 2-butanone onto a 175 μm thick blue-pigmented polyethylene terephthalate support with CIELAB a*- and b*-values of −9.5 and −17.9 respectively subbed on the emulsion-coated side with subbing layer 01 giving layers after drying at 50° C. for 1 hour in a drying cupboard with the compositions given in Table 5.

TABLE 5

| | stabilizer | | | | R01 | T01 | T03 | S02 | S03 | |
|---|---|---|---|---|---|---|---|---|---|---|
| | Type | conc. mol % vs AgB | AgBeh coverage [g/m²] | Butvar B79 [g/m²] | mol % vs AgB | mol % vs AgB | mol % vs AgB | mol % vs AgB | mol % vs AgB | Oil [mg/m²] |
| Comparative example nr. | | | | | | | | | | |
| 9 | TCFA | 5.0 | 4.444 | 17.776 | 50 | 5 | 15 | 22.2 | 10 | 40 |
| 10 | TCFA | 10.0 | 4.444 | 17.776 | 50 | 5 | 15 | 22.2 | 10 | 40 |
| Invention example nr | | | | | | | | | | |
| 9 | MAE-01 | 10.0 | 4.444 | 17.776 | 50 | 5 | 15 | 22.2 | 10 | 40 |
| 10 | MAE-07 | 10.0 | 4.444 | 17.776 | 50 | 5 | 15 | 22.2 | 10 | 40 |
| 11 | MAE-08 | 10.0 | 4.444 | 17.776 | 50 | 5 | 15 | 22.2 | 10 | 40 |
| 12 | MAE-10 | 10.0 | 4.444 | 17.776 | 50 | 5 | 15 | 22.2 | 10 | 40 |
| 13 | TCFIA-01 | 10.0 | 4.444 | 17.776 | 50 | 5 | 15 | 22.2 | 10 | 40 |

The thermosensitive elements were then coated with an aqueous composition with the following ingredients, which was adjusted to a pH of 3.8 with 1N nitric acid, to a wet layer thickness of 85 μm and then dried for 2 minutes at room temperature in situ and then at 50° C. for 15 minutes to produce a protective layer with the composition:

| | |
|---|---|
| ERCOL ™ 48 20 = | 2.1 g/m$^2$ |
| LEVASIL ™ VP AC 4055 = | 1.05 g/m$^2$ |
| ULTRAVON ™ W = | 0.075 g/m$^2$ |
| SYLOID ™ 72 = | 0.09 g/m$^2$ |
| SERVOXYL ™ VPDZ 3/100 = | 0.075 g/m$^2$ |
| SERVOXYL ™ VPAZ 100 = | 0.075 g/m$^2$ |
| MICROACE TALC P3 = | 0.045 g/m$^2$ |
| RILANIT ™ GMS = | 0.15 g/m$^2$ |
| TMOS = | 0.87 g/m$^2$ (assuming that the TMOS was completely converted to $SiO_2$) |

After coating the protective layer was hardened by heating the substantially light-insensitive thermographic material at 45° C. for 7 days at a relative humidity of 70%.

Thermographic Printing

Thermographic printing of the substantially light-insensitive thermographic recording materials of INVENTION EXAMPLES 9 to 13 and COMPARATIVE EXAMPLES 9 and 10 was carried out as described for INVENTION EXAMPLES 1 to 6 and COMPARATIVE EXAMPLES 1 to 5.

The maximum densities of the images ($D_{max}$) were measured through a visible filter with a MACBETH™ TR924 densitometer.

Evaluation of Thermographic Properties

The thermographic properties of the substantially light-insensitive thermographic recording materials of INVENTION EXAMPLES 9 to 13 and COMPARATIVE EXAMPLES 9 and 10 were evaluated as described for INVENTION EXAMPLES 1 to 6 and COMPARATIVE EXAMPLES 1 to 5. The results are summarized in Table 6.

The results in Table 6 show that as the substantially light-insensitive thermographic recording materials with a thermosensitive element containing at least one compound selected from the group consisting of mono-alkyl tetrachlorophthalates, di-alkyl tetra-chlorophthalates and N,N'-bis-α,ω-(tetrachlorophalimidyl)-n-hexane exhibit comparable archival stability and CIELAB b* values at a density of 1.0 to substantially light-insensitive thermographic recording materials with a thermosensitive element containing TCFA, but surprisingly at substantially higher Dmax values.

TABLE 6

| | stabilizer | | | b* CIELAB- | Density shift ΔD at D = 1 of prints after 3 d/ |
|---|---|---|---|---|---|
| | type | conc. mol % vs AgB | Dmax | values of fresh prints at D = 1.0 | 57° C./ 34% RH dark storage |
| Comparative Example nr. | | | | | |
| 9 | TCFA | 5.0 | 2.54 | −4.30 | +0.15 |
| 10 | TCFA | 10.0 | 2.39 | −5.43 | +0.11 |

TABLE 6-continued

| | stabilizer | | | b* CIELAB- | Density shift ΔD at D = 1 of prints after 3 d/ |
|---|---|---|---|---|---|
| | type | conc. mol % vs AgB | Dmax | values of fresh prints at D = 1.0 | 57° C./ 34% RH dark storage |
| Invention example nr | | | | | |
| 9 | MAE-01 | 10.0 | 2.89 | −5.23 | +0.11 |
| 10 | MAE-07 | 10.0 | 2.87 | −5.05 | +0.17 |
| 11 | MAE-08 | 10.0 | 2.91 | −5.24 | +0.11 |
| 12 | MAE-10 | 10.0 | 2.89 | −4.92 | +0.17 |
| 13 | TCFIA-01 | 10.0 | 2.96 | | +0.16 |

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practised otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A substantially light-insensitive thermographic recording material comprising a support and a thermosensitive element, said thermosensitive element containing a substantially light-insensitive organic silver salt, an organic reducing agent therefor in thermal working relationship therewith, a binder and at least one compound selected from the group consisting of mono-alkyl tetrachlorophthalates, di-alkyl tetrachlorophthalates and N-(tetrachlorophthalimyl)$_n$-alkanes, wherein n is an integer greater than or equal to 1.

2. Substantially light-insensitive thermographic recording material according to claim 1, wherein said mono-alkyl tetrachloro-phthalate is a mono-$C_1$-$C_{10}$-alkyl tetrachlorophthalate.

3. Substantially light-insensitive thermographic recording material according to claim 1, wherein said di-alkyl tetrachlorophthalate is a di-$C_1$-$C_{10}$-alkyl tetrachlorophthalate in which the alkyl groups are independent of one another.

4. Substantially light-insensitive thermographic recording material according to claim 1, wherein said mono-alkyl tetrachlorophthalate is monomethyl tetrachlorophthalate.

5. Substantially light-insensitive thermographic recording material according to claim 1, wherein n is at least 2.

6. Substantially light-insensitive thermographic recording material according to claim 1, wherein said at least one compound selected from the group consisting of mono-alkyl tetrachlorophthalates, di-alkyl tetrachlorophthalates and N-(tetrachlorophthalimyl)$_n$-alkanes is N,N'-bis-α,ω-(tetrachlorophalimidyl)-n-hexane.

7. Substantially light-insensitive thermographic recording material according to claim 1, wherein said thermosensitive element further comprises tetrachlorophthalic anhydride and/or tetrachlorophthalic acid.

* * * * *